US008976092B2

(12) United States Patent
Hussain et al.

(10) Patent No.: US 8,976,092 B2
(45) Date of Patent: Mar. 10, 2015

(54) DISPLAY CIRCUITRY WITH DYNAMIC PIXEL BACKLIGHT AND BACKLIGHT SLOPING CONTROL

(71) Applicant: Apple Inc., Cupertino, CA (US)

(72) Inventors: Asif Hussain, San Jose, CA (US); Jingdong Chen, San Jose, CA (US); Mohammad Jafar Navabi-Shirazi, Cupertino, CA (US); Manisha Pandya, Sunnyvale, CA (US); Alejandro L. Ascorra, Gilbert, AZ (US)

(73) Assignee: Apple Inc., Cupertino, CA (US)

( * ) Notice: Subject to any disclaimer, the term of this patent is extended or adjusted under 35 U.S.C. 154(b) by 148 days.

(21) Appl. No.: 13/756,259

(22) Filed: Jan. 31, 2013

(65) Prior Publication Data

US 2014/0210697 A1 Jul. 31, 2014

(51) Int. Cl.

| | |
|---|---|
| ***G09G 3/34*** | (2006.01) |
| ***G09G 3/36*** | (2006.01) |
| ***G09G 5/10*** | (2006.01) |

(52) U.S. Cl.

CPC ..... *G09G 5/10* (2013.01)
USPC ..... 345/84; 345/102

(58) Field of Classification Search

USPC ..... 345/84
See application file for complete search history.

(56) References Cited

U.S. PATENT DOCUMENTS

| | | | | |
|---|---|---|---|---|
| 7,113,163 | B2 * | 9/2006 | Nitta et al. | 345/102 |
| 7,825,938 | B2 | 11/2010 | Chen | |
| 8,004,489 | B2 | 8/2011 | Chen | |
| 2009/0102783 | A1 | 4/2009 | Hwang et al. | |
| 2011/0175949 | A1 | 7/2011 | Wallener et al. | |
| 2011/0249034 | A1 * | 10/2011 | Nagai | 345/690 |
| 2012/0019492 | A1 | 1/2012 | Barnhoefer et al. | |

OTHER PUBLICATIONS

Tripathi et al., U.S. Appl. No. 13/438,409, filed Apr. 3, 2012.
Land et al., U.S. Appl. No. 13/746,549, filed Jan. 22, 2013.
Lynch et al., U.S. Appl. No. 13/364,100, filed Feb. 1, 2012.
Gardner, U.S. Appl. No. 13/100,757, filed May 4, 2011.
Sacchetto et al., U.S. Appl. No. 13/588,978, filed Aug. 17, 2012.

* cited by examiner

*Primary Examiner* — Charles V Hicks
(74) *Attorney, Agent, or Firm* — Treyz Law Group; Jason Tsai

(57) ABSTRACT

A system may include a processor, a graphics controller, and a display. The graphics controller may generate video data to be presented on the display. The display may include a display panel, a backlight unit for providing the display panel with backlight, and a display timing controller for communicating with the graphics controller. The display may be used in non-movie mode and movie mode. The backlight unit may be operated in fixed backlight mode during the non-movie display mode and may be operated in dynamic pixel backlight (DPB) mode during the movie display mode. Backlight level adjustments may be sloped only during the non-movie mode. Backlight level sloping can be handled internally within the backlight unit, can be controlled using pulse width modulation with the display timing controller, and implemented using incremental backlight level adjustments with the processor.

20 Claims, 9 Drawing Sheets

DISPLAY CIRCUITRY WITH DYNAMIC PIXEL BACKLIGHT AND BACKLIGHT SLOPING CONTROL

BACKGROUND

This relates generally to displays, and more particularly, to displays with backlights.

Displays such as liquid crystal displays and other displays sometimes include backlight units. A backlight unit may include an array of light-emitting diodes and a backlight control integrated circuit (sometimes referred to as a backlight driver) that directly controls the array of light-emitting diodes. Displays with backlight units may be incorporated into an electronic device such as a computer or cellular telephone or may be implemented as stand-alone units.

There is an increasing demand for electronic devices such as portable computers to be capable of supporting both a non-movie mode and a movie mode. For example, a laptop computer may be operated in the non-movie mode when a user is using the laptop computer to give a presentation or to run a text-editing application. The laptop computer may also be operated in the movie mode when the user is using the laptop computer to watch a movie. In either mode, the backlight unit is used to output a fixed backlight level such that the intensity of light generated by the light-emitting diodes remains constant from frame to frame.

Implementing the fixed backlight level in the movie mode, however, consumes an excessive amount of power. Consider, for example, a scenario in which two consecutive frames in the movie mode transition from a bright scene to a dark scene. In this example, the backlight unit would output a fixed backlight level in both the bright scene and the dark scene. Display pixels in the liquid crystal display contain thin-film transistors and electrodes for applying electric fields to the liquid crystal material. The strength of the electric field in each display pixel controls the polarization state of the liquid crystal material and thereby adjusts the brightness of each display pixel (i.e., changes in brightness from frame to frame is adjusted via control of the liquid crystal material without any adjustment to the backlight level).

It would therefore be desirable to be able to provide improved ways in which to control the brightness level of the display in the different display modes.

SUMMARY

A system may include storage and processing circuitry, a graphics controller, and a display. The graphics controller may generate video data to be displayed on the display. The display may include a display panel for displaying the video data, a backlight unit for providing the display panel with backlight, and a display timing controller for communicating with the graphics controller.

The display may be used in a first mode (e.g., a movie mode) and a second mode (e.g., a non-movie or "presentation" mode). A user of the system may request a mode switch event that causes the system to transition from one mode to the other. Mode switch events may be handled by software running on the storage and processing circuitry.

While transitioning from the movie mode to the non-movie mode, backlight sloping (ramping) control may be activated. The backlight sloping control may be handled internally by the backlight unit, by the display timing controller, or by the storage and processing circuitry (as examples). When the backlight sloping control is activated, the backlight unit may output backlight levels that change at predetermined rates.

While transitioning from the non-movie mode to the movie mode, backlight sloping control may be deactivated. When the backlight sloping control is deactivated, the backlight unit may output backlight levels that change at rates that are substantially greater than the predetermined rates.

When the display is being used in the movie mode, the backlight unit may be operated in dynamic pixel brightness (DPB) mode. In the DPB mode, the backlight unit may be configured to output backlight levels that can vary from frame to frame (e.g., backlight brightness levels that change between consecutive frames that are being displayed on the display). When the display is being used in the non-movie mode, the backlight unit may be operated in a fixed backlight mode. In the fixed backlight (or non-DPB) mode, the backlight unit may be configured to output a backlight level that remains substantially constant. Backlight sloping control should not be activated when the display is in the movie mode.

In one suitable arrangement, the backlight unit may include a slope control circuit that internally handles backlight sloping control. For example, the display timing controller may provide a DPB enable signal to the slope control circuit. The slope control circuit, when activated, may be used to provide the backlight sloping function. The display timing controller may deassert the enable signal when the display is transitioning from the movie mode to the non-movie mode and may assert the enable signal when the display is transitioning from the non-movie mode to the movie mode. Asserting the control signal deactivates the slope control circuit, whereas deasserting the control signal activates the slope control circuit.

In another suitable arrangement, the backlight sloping control may be handled by the display timing controller. When the display is in non-movie mode and when the timing controller receives a request from the storage and processing circuitry to adjust backlight levels, the display timing controller may output to the backlight unit a control signal with duty cycles that change at a predetermined rate (e.g., the display timing controller may output a control signal with incrementally increasing pulse widths). When the display is placed in the movie mode, the graphics controller may direct the display timing controller to output to the backlight unit a control signal with duty cycles that change at a rate that is greater than the predetermined sloping rate.

In another suitable arrangement, the backlight sloping control may be handled directly using the storage and processing circuitry. When the display is in non-movie mode, the storage and processing circuitry may send incremental backlight level adjustment requests to the display timing controller via the graphics controller, where the requested levels change at a predetermined rate (e.g., an incrementally sloping rate). When the display is in movie mode, the storage and processing circuitry may send backlight level requests to the display timing controller via the graphics controller, where the requested levels change at a rate that is substantially greater than the predetermined rate (e.g., brightness changes may be effected instantaneously without sloping).

Further features of the present invention, its nature and various advantages will be more apparent from the accompanying drawings and the following detailed description.

DETAILED DESCRIPTION

Electronic devices may include displays. The displays may be used to display images to a user. Illustrative electronic devices that may be provided with displays are shown in FIGS. 1, 2, and 3.

Figure 1:
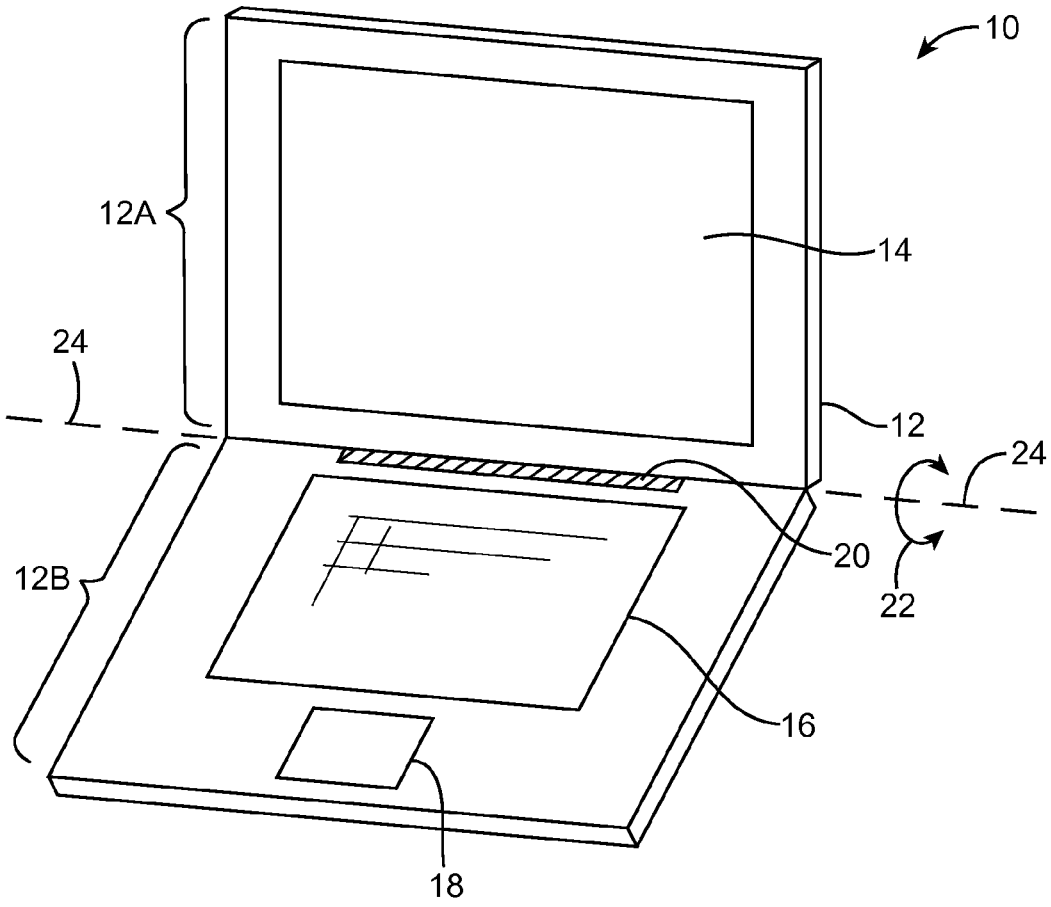
FIG. 1 is a perspective view of an illustrative electronic device such as a laptop computer with a display in accordance with an embodiment of the present invention.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
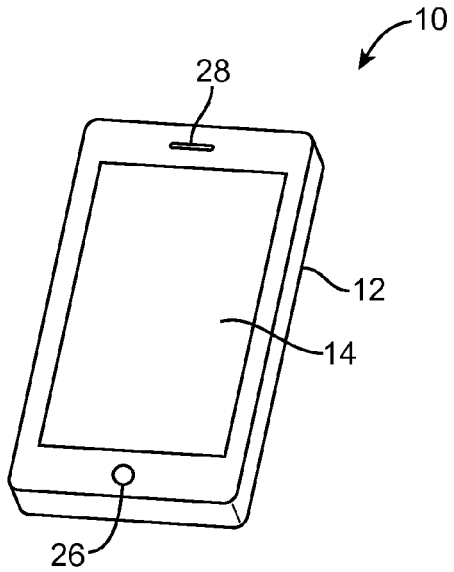
FIG. 2 is a perspective view of an illustrative electronic device such as a handheld electronic device with a display in accordance with an embodiment of the present invention.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have a display cover layer or other exterior layer that includes openings for components such as button 26. Openings may also be formed in a display cover layer or other display layer to accommodate a speaker port (see, e.g., speaker port 28 of FIG. 2).

Figure 3:
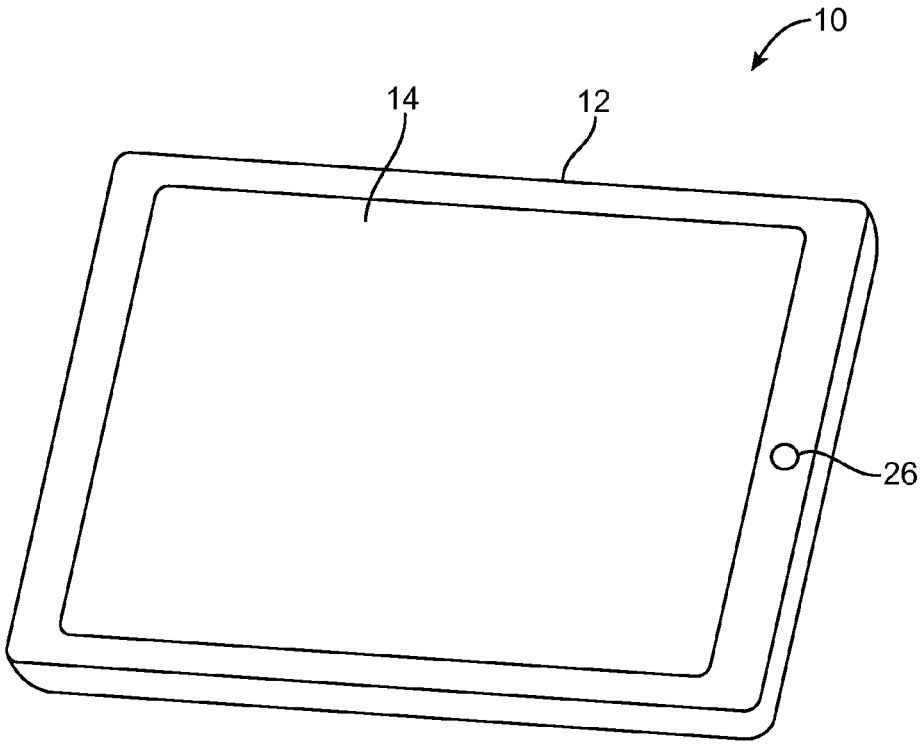
FIG. 3 is a perspective view of an illustrative electronic device such as a tablet computer with a display in accordance with an embodiment of the present invention.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have a cover layer or other external layer with an opening to accommodate button 26 (as an example).

The illustrative configurations for device 10 that are shown in FIGS. 1, 2, and 3 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Displays for device 10 may, in general, include image pixels formed from light-emitting diodes (LEDs), organic LEDs (OLEDs), plasma cells, electrowetting pixels, electrophoretic pixels, liquid crystal display (LCD) components, or other suitable image pixel structures. In some situations, it may be desirable to use LCD components to form display 14, so configurations for display 14 in which display 14 is a liquid crystal display are sometimes described herein as an example. It may also be desirable to provide displays such as display 14 with backlight structures, so configurations for display 14 that include a backlight unit may sometimes be described herein as an example. Other types of display technology may be used in device 10 if desired. The use of liquid crystal display structures and backlight structures in device 10 is merely illustrative.

A display cover layer may cover the surface of display 14 or a display layer such as a color filter layer or other portion of a display may be used as the outermost (or nearly outermost) layer in display 14. A display cover layer or other outer display layer may be formed from a transparent glass sheet, a clear plastic layer, or other transparent member.

Touch sensor components such as an array of capacitive touch sensor electrodes formed from transparent materials such as indium tin oxide may be formed on the underside of a display cover layer, may be formed on a separate display layer such as a glass or polymer touch sensor substrate, or may be integrated into other display layers (e.g., substrate layers such as a thin-film transistor layer).

Figure 4:
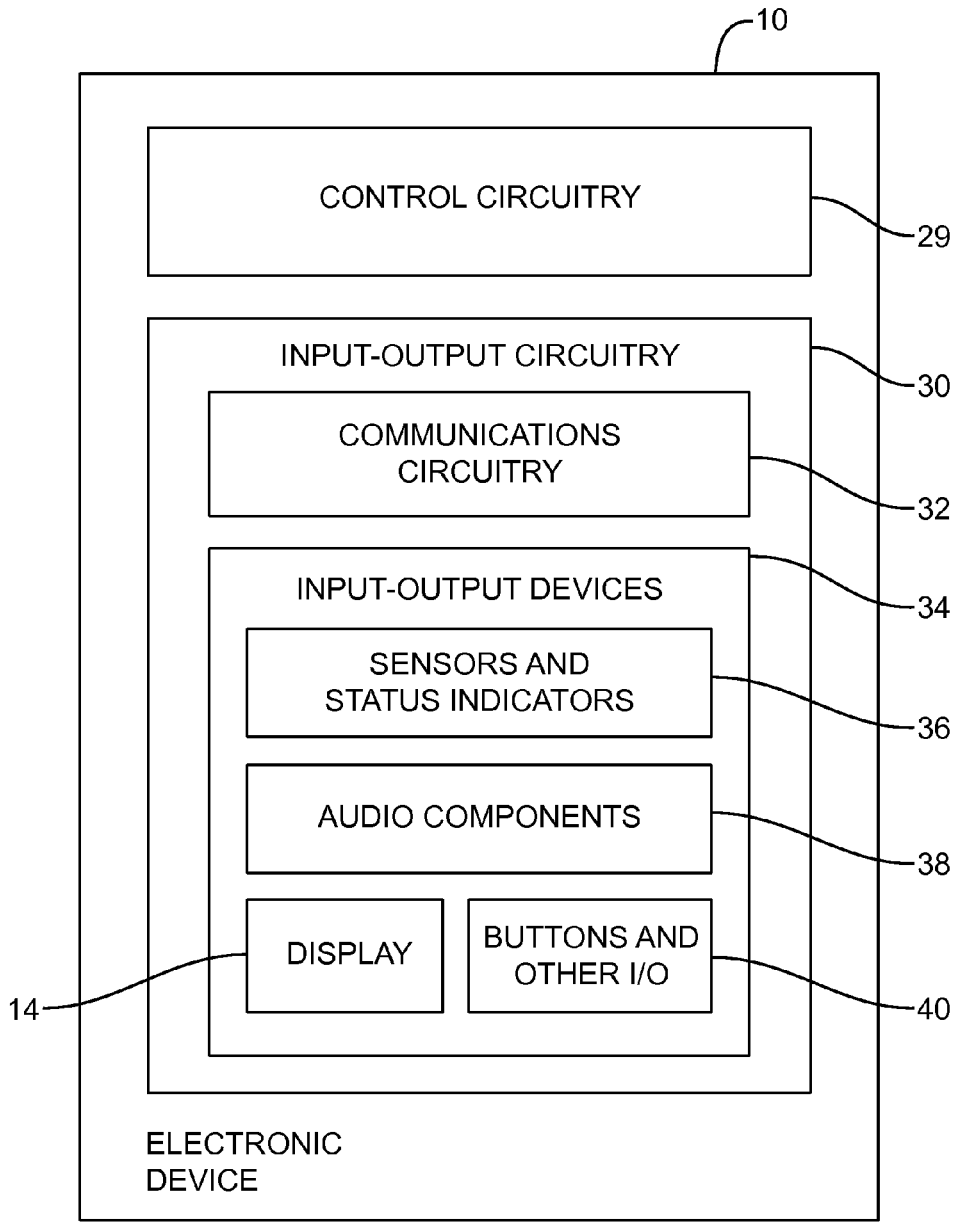
FIG. 4 is a schematic diagram of an illustrative electronic device with a display in accordance with an embodiment of the present invention.

A schematic diagram of an illustrative configuration that may be used for electronic device 10 is shown in FIG. 4. As shown in FIG. 4, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may present information to a user of electronic device 10 on display 14. When presenting information to a user on display 14, sensor signals and other information may be used by control circuitry 29 in making adjustments to the strength of backlight illumination that is used for display 14.

Input-output circuitry 30 may be used to allow data to be supplied to device 10 and to allow data to be provided from device 10 to external devices. Input-output circuitry 30 may include communications circuitry 32. Communications circuitry 32 may include wired communications circuitry for supporting communications using data ports in device 10. Communications circuitry 32 may also include wireless communications circuits (e.g., circuitry for transmitting and receiving wireless radio-frequency signals using antennas).

Input-output circuitry 30 may also include input-output devices 34. A user can control the operation of device 10 by supplying commands through input-output devices 34 and may receive status information and other output from device 10 using the output resources of input-output devices 34.

Input-output devices 34 may include sensors and status indicators 36 such as an ambient light sensor, a proximity sensor, a temperature sensor, a pressure sensor, a magnetic sensor, an accelerometer, and light-emitting diodes and other components for gathering information about the environment in which device 10 is operating and providing information to a user of device 10 about the status of device 10.

Audio components 38 may include speakers and tone generators for presenting sound to a user of device 10 and microphones for gathering user audio input.

Display 14 may be used to present images for a user such as text, video, and still images. Sensors 36 may include a touch sensor array that is formed as one of the layers in display 14.

User input may be gathered using buttons and other input-output components 40 such as touch pad sensors, buttons, joysticks, click wheels, scrolling wheels, touch sensors such as sensors 36 in display 14, key pads, keyboards, vibrators, cameras, and other input-output components.

Figure 5:
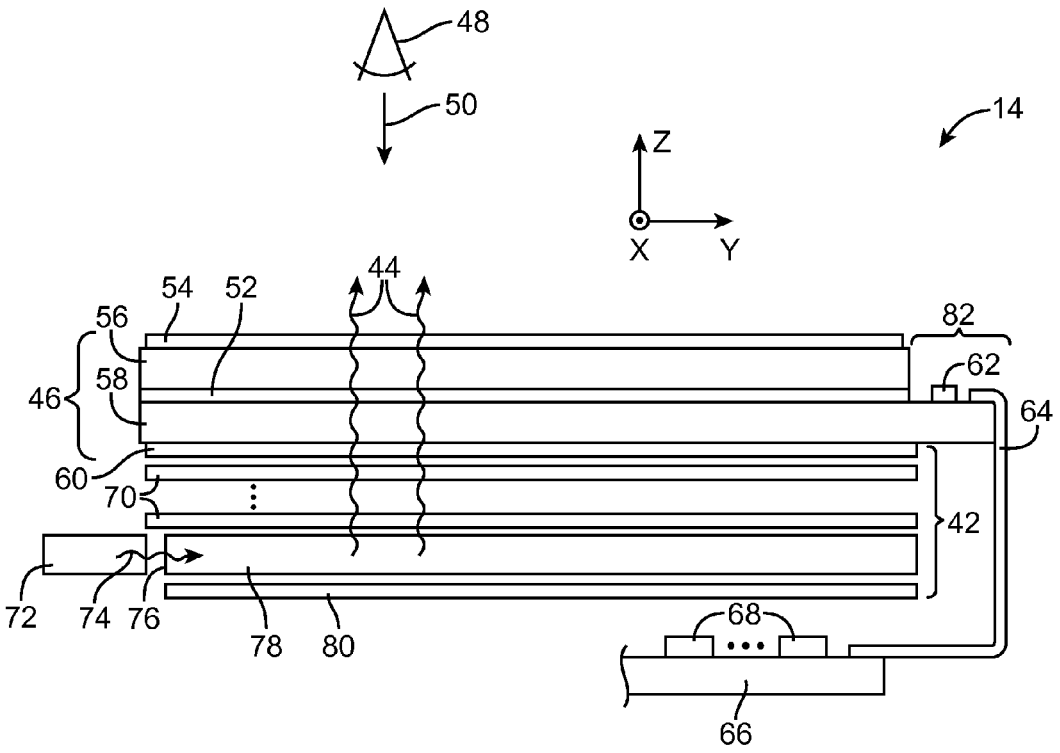
FIG. 5 is a cross-sectional side view of an illustrative display in accordance with an embodiment of the present invention.

A cross-sectional side view of an illustrative configuration that may be used for display 14 of device 10 (e.g., for display 14 of the devices of FIG. 1, FIG. 2, or FIG. 3 or other suitable electronic devices) is shown in FIG. 5. As shown in FIG. 5, display 14 may include backlight structures such as backlight unit 42 for producing backlight 44. During operation, backlight 44 travels outwards (vertically upwards in dimension Z in the orientation of FIG. 5) and passes through display pixel structures in display layers 46. This illuminates any images that are being produced by the display pixels for viewing by a user. For example, backlight 44 may illuminate images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 may form a liquid crystal display or may be used in forming displays of other types.

In a configuration in which display layers 46 are used in forming a liquid crystal display, display layers 46 may include a liquid crystal layer such a liquid crystal layer 52. Liquid crystal layer 52 may be sandwiched between display layers such as display layers 58 and 56. Layers 56 and 58 may be interposed between lower polarizer layer 60 and upper polarizer layer 54.

Layers 58 and 56 may be formed from transparent substrate layers such as clear layers of glass or plastic. Layers 56 and 58 may be layers such as a thin-film transistor layer and/or a color filter layer. Conductive traces, color filter elements, transistors, and other circuits and structures may be formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 may be a thin-film transistor layer that includes an array of thin-film transistors and associated electrodes (display pixel electrodes) for applying electric fields to liquid crystal layer 52 and thereby displaying images on display 14. Layer 56 may be a color filter layer that includes an array of color filter elements for providing display 14 with the ability to display color images. If desired, layer 58 may be a color filter layer and layer 56 may be a thin-film transistor layer.

During operation of display 14 in device 10, control circuitry 29 (e.g., one or more integrated circuits such as components 68 on printed circuit 66 of FIG. 5) may be used to generate information to be displayed on display 14 (e.g., display data). The information to be displayed may be conveyed from circuitry 68 to display driver integrated circuit 62 using a signal path such as a signal path formed from conductive metal traces in flexible printed circuit 64 (as an example).

Display driver integrated circuit 62 may be mounted on thin-film-transistor layer driver ledge 82 or elsewhere in device 10. A flexible printed circuit cable such as flexible printed circuit 64 may be used in routing signals between printed circuit 66 and thin-film-transistor layer 58. If desired, display driver integrated circuit 62 may be mounted on printed circuit 66 or flexible printed circuit 64. Printed circuit 66 may be formed from a rigid printed circuit board (e.g., a layer of fiberglass-filled epoxy) or a flexible printed circuit (e.g., a flexible sheet of polyimide or other flexible polymer layer).

Backlight structures 42 may include a light guide plate such as light guide plate 78. Light guide plate 78 may be formed from a transparent material such as clear glass or plastic. During operation of backlight structures 42, a light source such as light source 72 may generate light 74. Light source 72 may be, for example, an array of light-emitting diodes.

Light 74 from light source 72 may be coupled into edge surface 76 of light guide plate 78 and may be distributed in dimensions X and Y throughout light guide plate 78 due to the principal of total internal reflection. Light guide plate 78 may include light-scattering features such as pits or bumps. The light-scattering features may be located on an upper surface and/or on an opposing lower surface of light guide plate 78.

Light 74 that scatters upwards in direction Z from light guide plate 78 may serve as backlight 44 for display 14. Light 74 that scatters downwards may be reflected back in the upwards direction by reflector 80. Reflector 80 may be formed from a reflective material such as a layer of white plastic or other shiny materials.

To enhance backlight performance for backlight structures 42, backlight structures 42 may include optical films 70. Optical films 70 may include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 may overlap the other structures in backlight unit 42 such as light guide plate 78 and reflector 80. For example, if light guide plate 78 has a rectangular footprint in the X-Y plane of FIG. 5, optical films 70 and reflector 80 may have a matching rectangular footprint.

There is an increasing demand for portable/handheld electronic devices such as those described in FIGS. 1, 2, and 3 to support a normal non-movie mode and a movie mode. When device 10 is placed in non-movie mode, the user can operate device 10 to give presentations, to display text-editing applications, to display an Internet browser, etc. The non-movie mode may therefore sometimes be referred to as the "presentation" mode. When device 10 is placed in the movie mode, the user can operate device 10 to display a movie or other media having rapidly changing pictures to be displayed.

In the non-movie mode, it may be desirable to keep the display brightness level relatively constant to provide a comfortable user experience (e.g., the backlight unit may output a fixed backlight level during the presentation mode). In the movie mode, however, consecutive frames may vary drastically in brightness levels (e.g., a bright scene may be immediately followed by a dark scene or a dark scene may be immediately followed by a bright scene). As a result, it may be desirable to dynamically vary the display brightness level from frame to frame so as to optimize the power savings in the movie mode. For example, backlight unit 42 may be configured to output a first backlight level when displaying a bright scene with display 14 and may be configured to output a second backlight level that is lower than the first backlight level when displaying a relatively darker scene with the display. The backlight unit may therefore operate in a fixed pixel backlight mode during the non-movie mode and in a dynamic pixel backlight (DPB) mode during the movie mode (see, e.g., FIG. 6).

Figure 6:
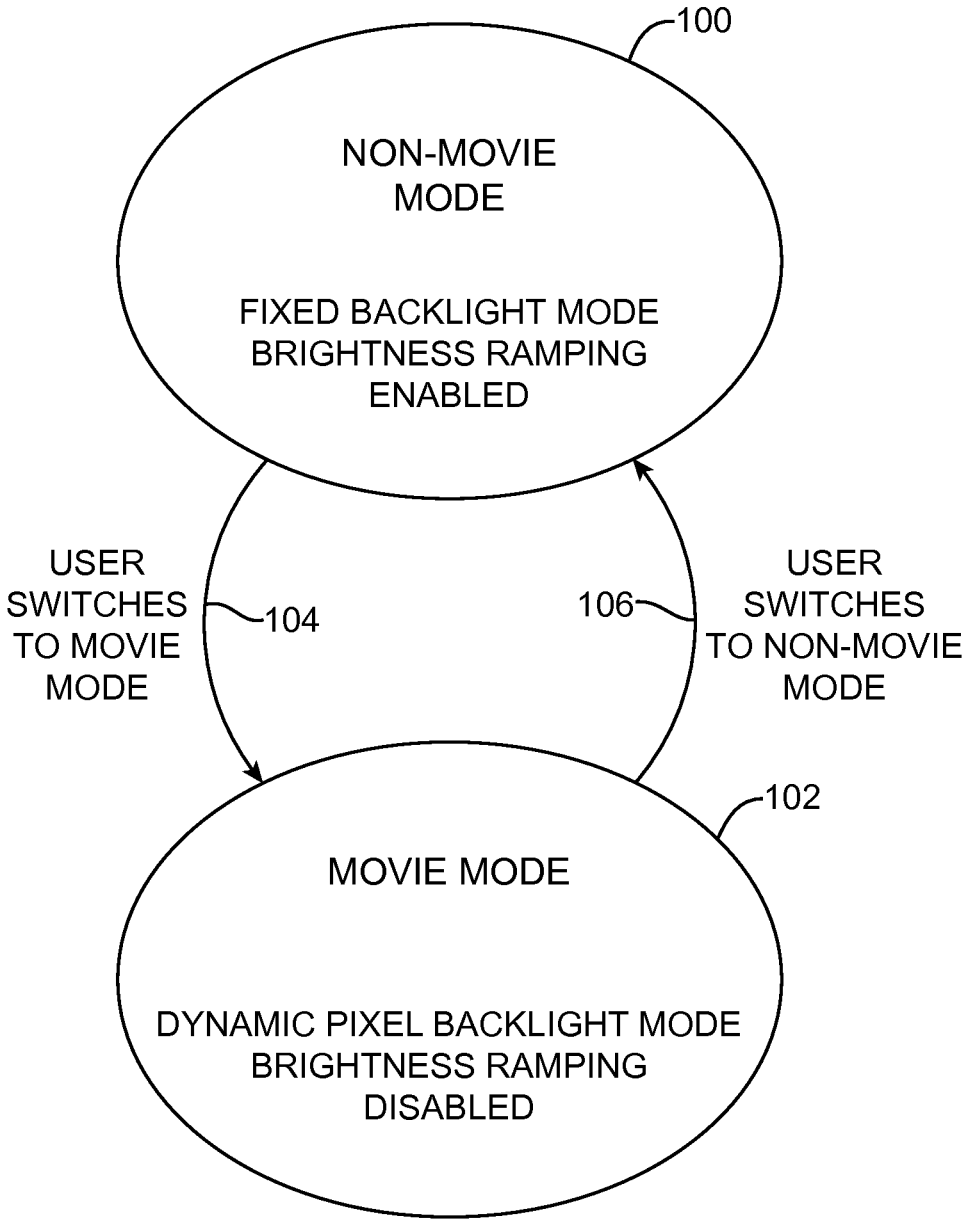
FIG. 6 is a diagram showing how an electronic device may be operable in a non-movie mode and a movie most in accordance with an embodiment of the present invention.

As shown in FIG. 6, device 10 may be operable in at least non-movie mode 100 and movie mode 102. When device 10 is configured in non-movie mode 100, the backlight unit may be configured to output a fixed backlight level and may have brightness ramping control enabled. In mode 100, brightness ramping is needed to provide a smooth transition between different brightness levels. For example, consider a scenario in which a user of device 10 decides to adjust the display brightness level from 50% to 70%. If device 10 were to instantaneously adjust the backlight level from 50% to 70% in a single step, the user will observe an abrupt change in brightness or an unpleasant flash. The brightness ramping (sometimes referred to as a backlight sloping control) function, when engaged, will result in the backlight level gradually ramping up in incremental steps (e.g., from 50% to 51% at a first point in time, from 51% to 52% at a second point in time after the first point in time, from 52% to 53% at a third point in time after the second point in time, etc.). Implementing backlight level sloping in this way ensures a more pleasant user experience.

In response to a user request, device 10 may switch from non-movie mode 100 to movie mode 102 (as indicated by path 104). For example, the user may open a movie application or device 10 may automatically launch a movie application in response to insertion of a DVD or other media storage. When device 10 is configured in movie mode 102, the backlight unit may be configured in DPB mode so that backlight levels can change from frame to frame to reduce power consumption. In mode 102, however, brightness ramping can be disabled since backlight levels are already being varied from frame to frame while taking into account all the display brightness parameters (e.g., while taking into account desired display brightness as set by the user, ambient light sensor information, overall brightness level associated with the current scene or frame to be displayed, and other display information).

In response to a user request, device 10 may switch from movie mode 102 back to non-movie mode 100 (as indicated by path 106). Problems may arise when transitioning between these two modes. For example, consider a scenario in which a user switches from the movie mode to the non-movie mode while manually adjusting the desired display brightness. During the transition, if the brightness ramping function is not enabled fast enough, the user may observe sudden changes in brightness and other visual artifacts. It may therefore be desirable to provide a way for seamlessly transitioning between the two modes while always ensuring pleasant user experience.

Figure 7:
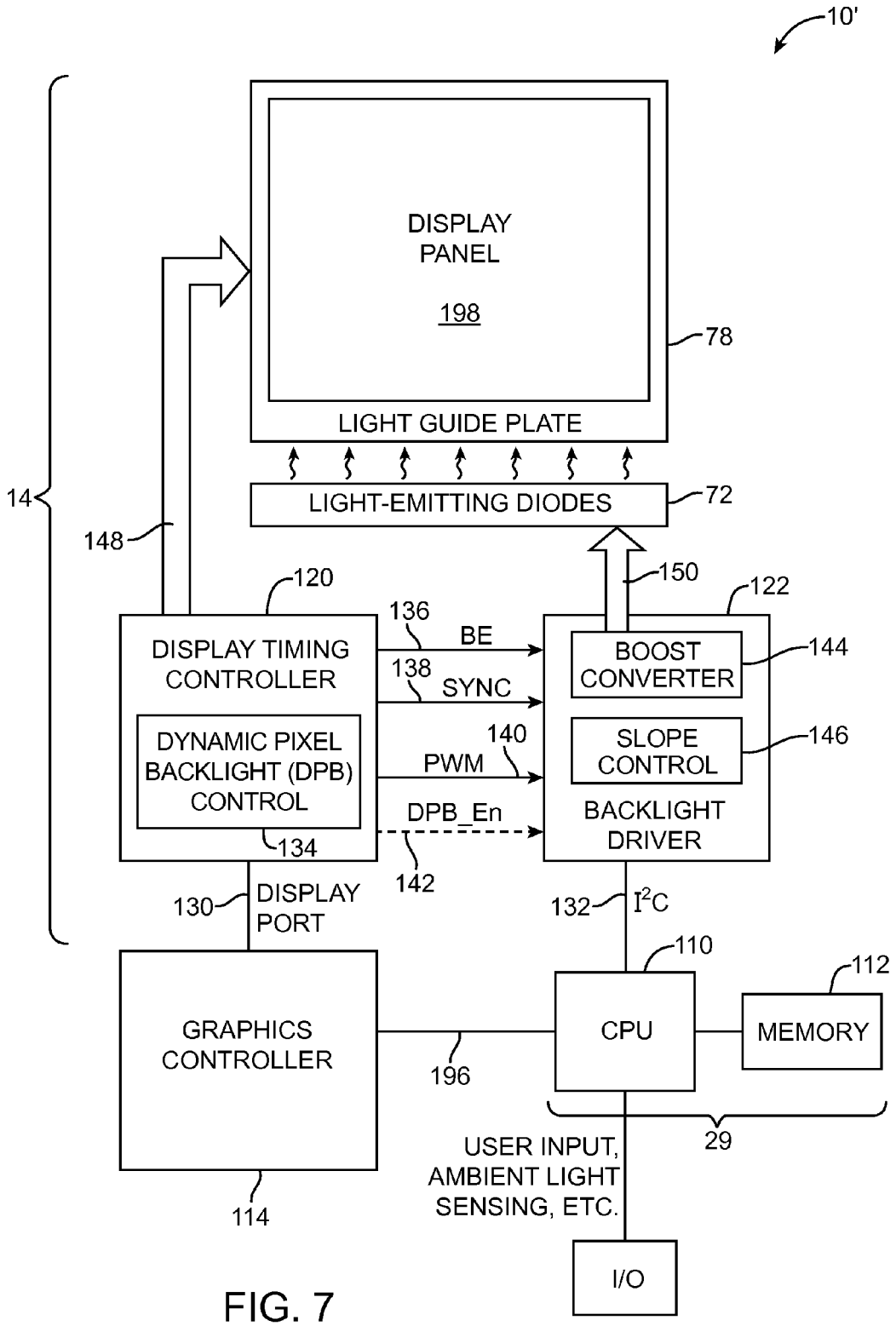
FIG. 7 is a diagram of an illustrative system with a display in accordance with an embodiment of the present invention.

FIG. 7 shows an illustrative system diagram of device 10 or a network of devices. As shown in FIG. 7, system 10' may include a graphics controller such as graphics controller 114 that is coupled to display structures 14. Graphics controller 114, which may sometimes be referred to as a video card or video adapter, may be used to provide video data and control signals to display 14. The video data may include text, graphics, images, moving video content, or other content to be presented on display 14.

Graphics controller 114 may receive video data to be displayed on display 14 from control circuitry 29. Control circuitry 29 may include processing circuitry 110 and storage 112. Processing circuitry 110 may include one or more processors such as central processing units (CPUs), microprocessors, microcontrollers, digital signal processors, application-specific integrated circuits, or other processing circuits. Storage 112 may include random-access memory, read-only memory, solid state memory in a solid state hard drive, magnetic storage, and other volatile and/or nonvolatile memory.

Input-output components such as sensors, touch sensor arrays, keyboards, buttons, microphones that receive voice input and other audio input, speakers that provide audio output, vibrators, status indicator lights, wireless and wired communications circuits for communicating with external equipment, and other components may be used for receiving input from a user or other external source and/or for conveying output to a user or other external destination.

Display 14 may include a display panel such as display panel 198, timing controller (ICON) circuitry such as display timing controller 120 (e.g., a ICON integrated circuit), and associated backlight structures. Display panel 198 may be a liquid crystal display module containing an array of display pixels, an electrophoretic display, an electrowetting display, or display structures using other types of display technologies. The backlight structures may include light guide plate 78, light source 72 (e.g., an array of light-emitting diodes), and backlight control circuitry such as backlight controller 122 (sometimes referred to as a backlight driver integrated circuit) that is used to control light source 72. Light guide plate 78, light source 72, backlight controller 122, and other associated circuitry may therefore sometimes be referred to collectively as a backlight unit.

Communications path 130 may be used to convey information between graphics controller 114 and display 14. Communications path 130 may, for example, serve as a video data path or display port for conveying video data bits and other control signals from graphics controller 114 to display timing controller 120.

The components of system 10' may be integrated into a single piece of electronic equipment or multiple pieces of electronic equipment. For example, system 10' may be implemented as a single electronic device such as a portable computer, a tablet computer, a cellular telephone, a media player, a computer display that includes an embedded computer, a television, or other stand-alone electronic equipment. In this type of configuration, communications path 130 may be formed from an internal bus.

If desired, system 10' may include a first piece of equipment such as a desktop computer, set-top box, or other equipment (formed from input-output circuitry 34, control circuitry 29, and graphics controller 114) that is coupled by path 130 to a second piece of equipment (e.g., a display such as display 14 that is mounted in a display housing to form a stand-alone computer display or other monitor). In this type of configuration, path 130 may be formed as part of a cable (e.g., a display cable). The display cable may be pigtailed to the first piece of equipment, may be pigtailed to the second piece of equipment, or may be a stand-alone cable having a first end coupled to the first piece of equipment and an opposing second end coupled to the second piece of equipment. Configurations for system 10' that include more than two pieces of equipment or that include components that are embedded into kiosks, automobiles, or other systems may also be used, if desired.

Display timing controller 120 may be used to provide data signals and control signals to display panel 198 via path 148. As an example, timing controller 120 may provide data signals via data lines and gate control signals via gate lines to each corresponding display pixel in display panel 198 via path 148. Control signals such as backlight enable control signal BE and display synchronization signals SYNC may be conveyed from display timing controller 120 to backlight driver 122 via paths 136 and 138, respectively. When backlight enable signal BE is asserted, backlight driver 122 may turn light source 72 on to illuminate the display panel via light guide plate 78. When backlight enable signal BE is deasserted, backlight driver 122 may turn light source 72 off. In the example of FIG. 7, backlight driver 122 may include a boost converter such as boost converter 144 for providing elevated voltage signals that are used to drive the array or chain of light-emitting diodes in light source 72 (e.g., by providing the boosted voltage signals to light source 72 via path 150).

The DPB mode may be implemented using a dynamic pixel backlight control circuit 134 that is part of controller 120 (e.g., control circuit 134 may be used to run a DPB algorithm that dynamically controls the backlight level based on the current frame to be displayed). As shown in FIG. 7, DPB control circuit 134 may provide a pulse width modulated control signal PWM to backlight driver 122 via path 140. Control circuit 134 may dynamically adjust the desired backlight level by modulating the pulse width of signal PWM (e.g., by adjusting the duty cycle of signal PWM). For example, during movie mode, signal PWM may exhibit a first duty cycle during a first display cycle and may exhibit a second duty cycle that is different from the first duty cycle during a second display cycle following the first display cycle. A larger duty cycle may result in a higher backlight level, whereas a smaller duty cycle may result in a lower backlight level. During non-movie mode, however, signal PWM may exhibit relatively constant duty cycles.

In one suitable arrangement, the backlight brightness level ramping control may be implemented using a slope control circuit 146 that is part of backlight driver 122. When slope control circuit 146 is activated, any request to instantaneously change backlight levels by a noticeable amount will result in a gradual (sloped) brightness change that is pleasant to the user (e.g., the backlight unit will output backlight levels that change at a predetermined rate when backlight sloping control is activated). When slope control circuit 146 is deactivated, any request to instantaneously change backlight levels will be immediately effected (e.g., backlight driver 122 will control light source 72 to output at the currently requested brightness level based on the duty cycle of signal PWM). In other words, the backlight unit will output backlight levels that change at a rate that is substantially greater than the predetermined rate when the backlight sloping control is deactivated. Brightness sloping/ramping should not be activated when the backlight unit is placed in DPB mode.

One way of activating and deactivating slope control circuit 146 involves sending a DPB enable signal DPB_En from display timing controller 120 to backlight driver 122 via path 142. As an example, signal DPB_En should be asserted when display 14 is placed in DPB mode, whereas signal DPB_En should be deasserted when display 14 is placed in fixed backlight mode. Signal DPB_En asserted/deasserted in this way may therefore serve as a control signal for selectively enabling slope control circuit 146 (e.g., an asserted DPB_En may turn off the brightness sloping function, whereas a deasserted DPB_En may turn on the brightness sloping function). Control of the brightness ramping functionality in this way incurs negligible latency since DPB control circuit 134 is responsible for enabling/disabling DPB mode in the first place and any mode switch that enters or exits DPB mode will be immediately handled by control circuit 134. Mode switching events may be handled using software running on processor 110 in response to user request (e.g., processor 110 may be configured to pass appropriate mode information to display timing controller 120 through graphics controller 114 via paths 130 and 196). Graphics controller 114 used in this way should not perform any brightness control.

Figure 8:
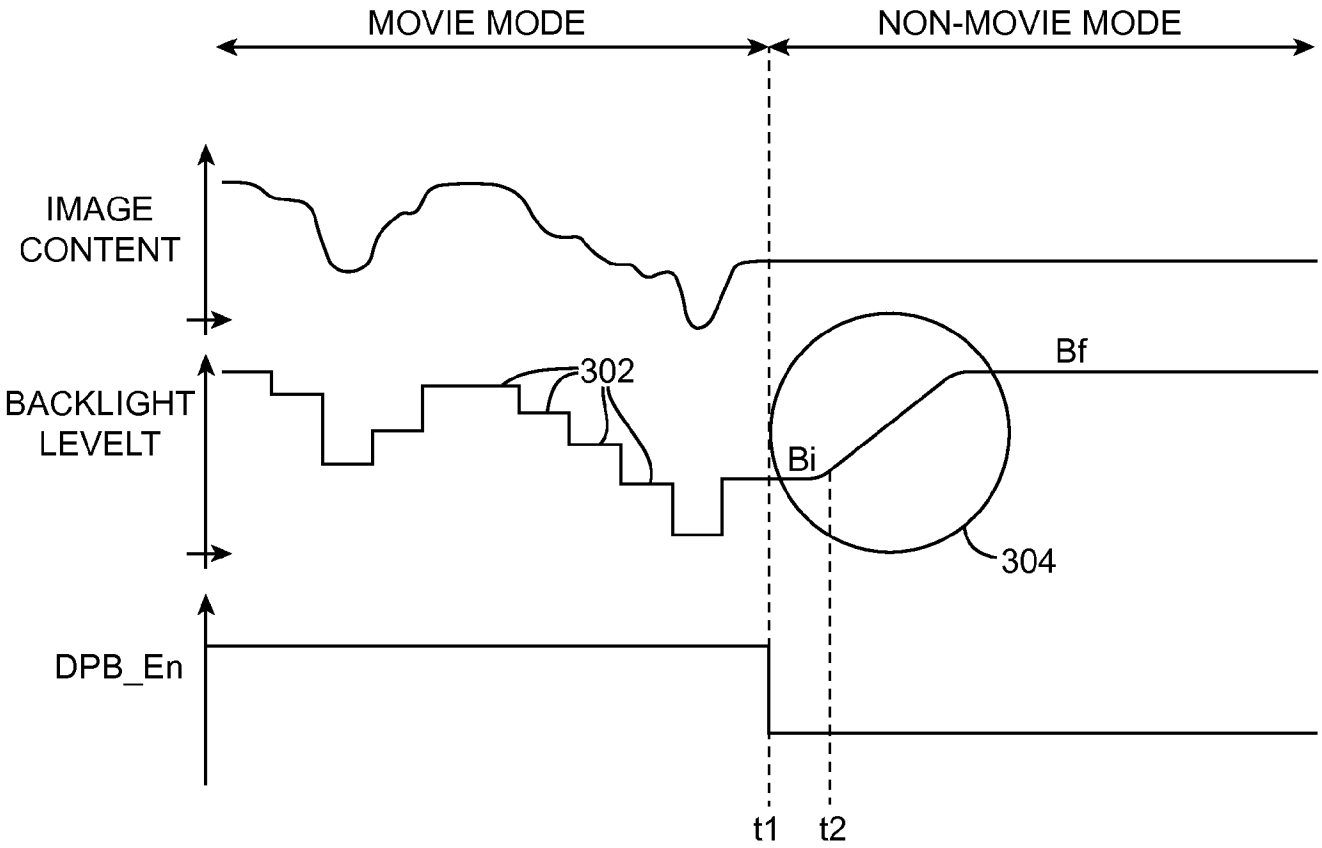
FIG. 8 is a timing diagram showing how display brightness level changes when an electronic device transitions from a movie mode to a non-movie mode in accordance with an embodiment of the present invention.

FIG. 8 is a timing diagram that illustrates control of the backlight level when display 14 transitions from the movie mode to the non-movie mode. As shown in FIG. 8, the image content to be presented by display 14 may vary dramatically from frame to frame during movie mode and may remain relatively stable during non-movie (presentation) mode. During movie mode, the backlight unit may be placed in DPB mode such that the backlight level dynamically tracks the brightness level of the image content from frame to frame (see, e.g., dynamically varying backlight levels 302). During movie mode, signal DPB_En may be asserted to deactivate slope control circuit 146.

At time t1, a request to switch from movie mode to non-movie may be received from the user (e.g., the user may exit a movie application or open a text-editing application). At this time, signal DPB_En may be deasserted to activate slope control circuit 146.

Figure 9:
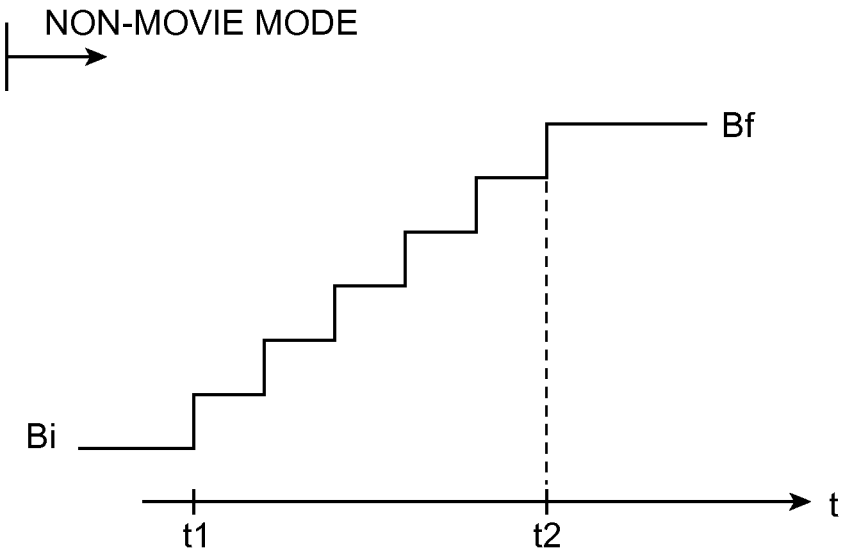
FIGS. 9 and 10 are timing diagrams illustrating various slope control mechanisms for controlling changes in backlight brightness level in accordance with an embodiment of the present invention.
Figure 10:
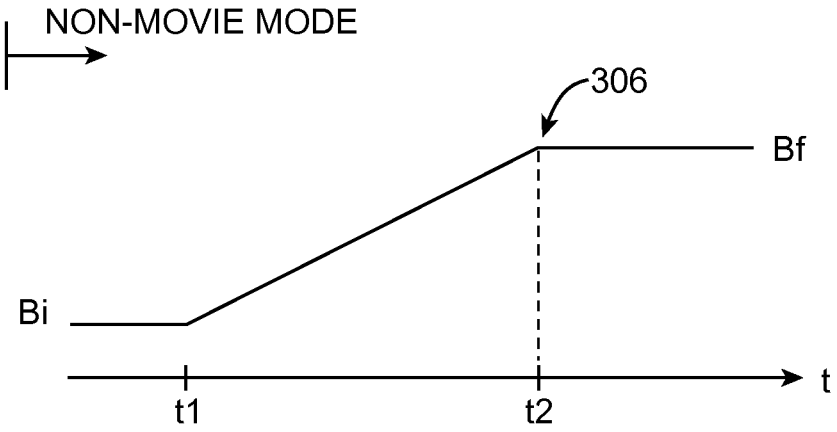

At time t2, device 10 may receive manual input from the user to increase the backlight level from level Bi to Bf. Since the slope control circuit 146 is enabled, the backlight level will increase from Bi to Bf with a predetermined slope as shown in sloping portion 304. The smooth transition 304 as shown in FIG. 8 is merely illustrative. If desired, brightness sloping may be implemented in multiple smaller steps (as shown in FIG. 9), as a linear ramp with sharp transition points 306 (as shown in FIG. 10), or using other suitable sloping techniques. Sloping control circuit 146 may be used to provide any desired amount of backlight sloping (e.g., sloping control circuit 146 may provide a predetermined ramp rate or programmable ramp rate). If desired, decreases in backlight level or other combinations of backlight level adjustments can be handled in this way.

In another suitable arrangement, the backlight brightness ramping control may be implemented by directly sloping the duty cycle of signal PWM using display timing controller 120. Display timing controller 120 may receive mode information from processor 110 via graphics controller 114. When an instantaneous brightness change is requested during non-movie mode, direct display timing controller 120 may output signals PWM with gradually increasing pulses. In other words, sloping is implemented by gradually increasing the duty cycle of signal PWM from one cycle to another. For example, the display timing controller may output signal PWM with duty changes that change at a predetermined rate during non-movie mode and to output PWM with duty cycles that change at a rate that is greater than the predetermined rate during movie mode. Slope control circuit 146 in backlight driver 122 need not be used in this arrangement. Control of the brightness ramping function in this way may be comparably slower than the alternate arrangement that uses the DPB enable signal, because the control of sloping is performed via multiple PWM cycles using display timing controller 120.

In another suitable arrangement, the brightness ramping control may be implemented directly using processor 110. For example, consider a first scenario in which display 14 is in movie mode and the current backlight level is set to 50%. In this scenario, a user request to change the backlight level from 50% to 70% may be instantaneously effected (e.g., processor 110 may send a request that directs display timing controller 120 to output signal PWM having a duty cycle corresponding to a 70% backlight output level). Consider a second scenario in which display 14 is in non-movie mode and the current backlight level is set 40%. In this second scenario, a user request to change the backlight level from 40% to 60% may be gradually effected (e.g., processor 110 may output a first request that directs controller 120 to output PWM having a first duty cycle corresponding to a 41% backlight level, a second request that directs controller 120 to output PWM having a second duty cycle corresponding to a 42% backlight level, a third request that directs controller 120 to output PWM having a third duty cycle corresponding to a 43% backlight level, etc.). Control of the brightness ramping function in this way may be comparably slower than the alternate arrangement that uses the DPB enable signal, because the control of sloping is performed using processor 114, which is several layers removed from backlight driver 122. If desired, the brightness ramping control may also be implemented by sending commands from processor 110 directly to backlight driver 122 via an inter-integrated circuit ($I^2C$) link 132.

Figure 11:
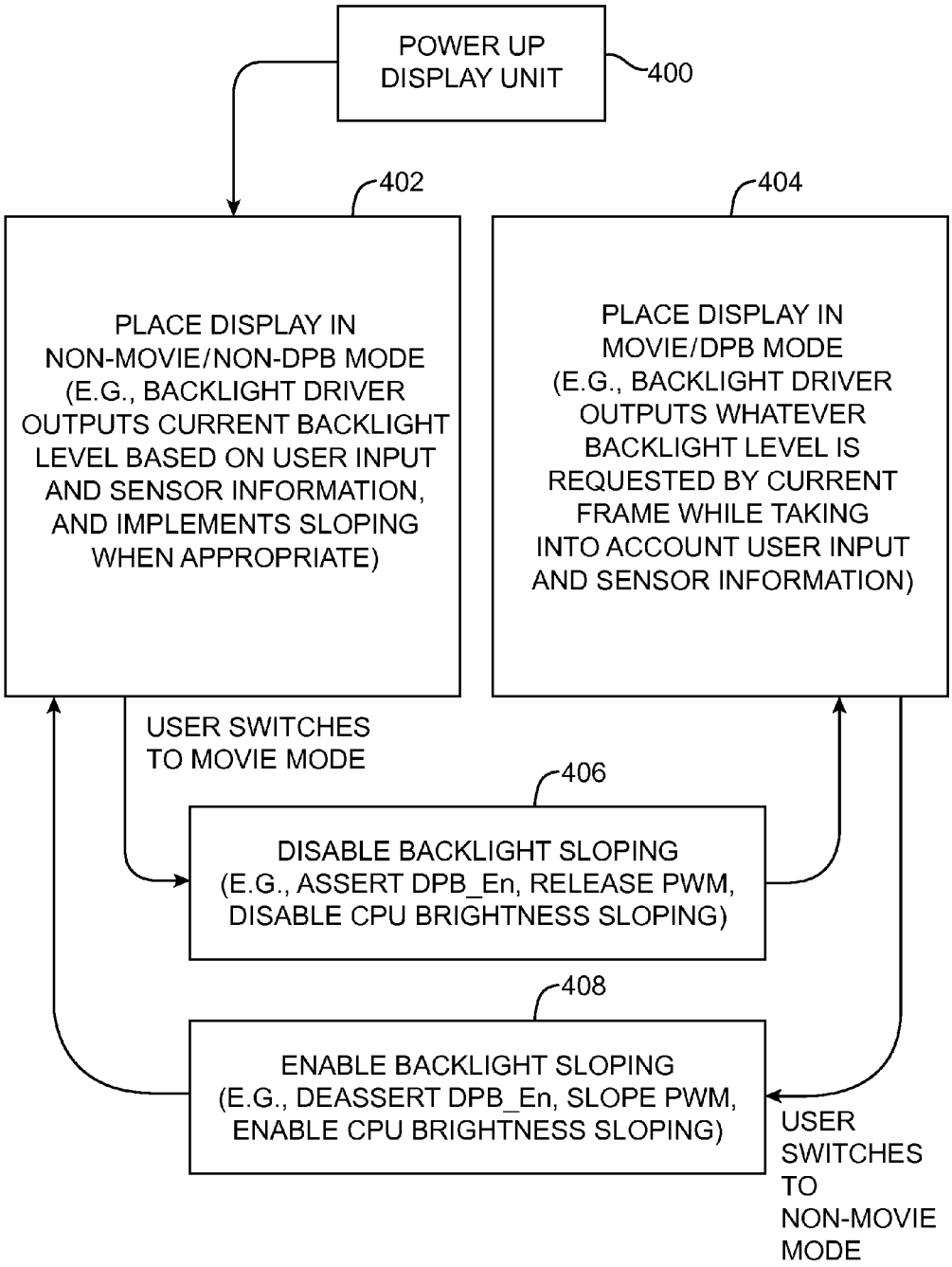
FIG. 11 is a flow chart of illustrative steps involved in using an electronic device that is operable in a dynamic pixel backlight display mode and a fixed pixel backlight display mode in accordance with an embodiment of the present invention.

FIG. 11 is a flow chart of illustrative steps involved in operating a device 10 or system 10' having a display operable in a movie mode and a non-movie mode in accordance with an embodiment of the present invention. At step 400, display unit 14 may be powered up.

At step 402, display 14 may be placed in non-movie (presentation) mode. In the non-movie mode, the backlight unit may be placed in non-DPB mode such that backlight driver 122 will output a current backlight level based on the user-selected brightness input and associated sensor information. If the requested backlight level is sufficiently greater than a previous backlight level, backlight level sloping may be implemented (e.g., backlight brightness level may be sloped if the difference between the request backlight level and the previous backlight level exceeds a predetermined threshold).

When the user wants to switch to movie mode, backlight level sloping may be disabled (step 406). As examples, signal DPB_En may be asserted to disable slope control circuit 146, PWM can freely change duty cycles from frame to frame as requested by processor 110, processor 110 may send as-requested backlight level commands directly to display timing controller 120, or other ways of toggling the backlight level sloping functionality can be used.

At step 404, display 14 may be placed in movie mode. In the movie mode, the backlight unit may be placed in DPB mode such that backlight driver 122 will output whatever backlight level that is being requested by the current frame to be displayed while taking into account the user-selected brightness input and any associated sensor data. Since backlight level sloping is disabled, no sloping should be performed when changing among different brightness levels.

When the user wants to switch back to non-movie mode, backlight level sloping may be enabled (step 408). As examples, signal DPB_En may be deasserted to enable slope control circuit 146, PWM sloping may be performed by gradually increasing/decreasing duty cycle from frame to frame), processor 110 may send incremental backlight level commands to display timing controller 120 that direct controller 120 to output sloping backlight levels, or other ways of toggling the backlight level sloping functionality can be used.

The foregoing is merely illustrative of the principles of this invention and various modifications can be made by those skilled in the art without departing from the scope and spirit of the invention. The foregoing embodiments may be implemented individually or in any combination.

What is claimed is:

1. A method for operating a system that includes a display having a backlight unit, the method comprising:

using the display in a first mode during a first time period;

using the display in a second mode that is different than the first mode during a second time period;

activating backlight sloping control while transitioning from the first mode to the second mode, wherein the backlight unit outputs backlight levels that change at a predetermined rate when the backlight sloping control is activated; and deactivating the backlight sloping control while transitioning from the second mode to the first mode, wherein the backlight unit outputs backlight levels that change at a rate that is greater than the predetermined rate when the backlight sloping control is deactivated.

2. The method defined in claim 1, wherein using the display in the first mode comprises using the display in a movie mode, and wherein using the display in the second mode comprises using the display in a non-movie mode.

3. The method defined in claim 1, further comprising:

operating the backlight unit in dynamic pixel brightness mode when the display is being used in the first mode, wherein the backlight levels change between consecutive frames that are being displayed on the display while the backlight unit is operating in the dynamic pixel brightness mode.

4. The method defined in claim 1, further comprising:

placing the backlight unit in fixed backlight mode when the display is being used in the second mode, wherein the backlight unit is configured to output a backlight level that remains constant between consecutive frames that are being displayed on the display while the backlight unit is operating in the fixed backlight mode.

5. The method defined in claim 1, wherein the system further includes a display timing controller, and wherein activating the backlight sloping control comprises providing an asserted control signal to disable a slope control circuit in the backlight unit.

6. The method defined in claim 5, wherein deactivating the backlight sloping control further comprises:

deasserting the control signal with the display timing controller to enable the slope control circuit in the backlight unit.

7. The method defined in claim 1, wherein the system further includes a display timing controller, and wherein activating the backlight sloping control comprises using the display timing controller to output a control signal with duty cycles that change at the predetermined rate to the backlight unit.

8. The method defined in claim 7, wherein deactivating the backlight sloping control further comprises:

allowing the display timing controller to output the control signals that exhibit duty cycles that change at the rate that is greater than the predetermined rate to the backlight unit.

9. The method defined in claim 1, wherein the system further includes a display timing controller, a graphics controller, and a processing circuit, the method further comprising:

when the display is in the first mode, sending incremental backlight level adjustments to the display timing controller with the processing circuit via the graphics controller.

10. A method of operating a system that includes a display having a backlight unit, the method comprising:

operating the backlight unit in a dynamic pixel brightness mode, wherein the backlight unit is configured to output backlight levels that change between consecutive frames;

operating the backlight unit in a fixed pixel brightness mode, wherein the backlight unit is configured to output a substantially constant backlight level; and enabling backlight ramping control only when the backlight unit is operating in the fixed pixel brightness mode.

11. The method defined in claim 10, further comprising:

disabling the backlight ramping control when the backlight unit is operating in the dynamic pixel brightness mode.

12. The method defined in claim 11, wherein the backlight unit outputs backlight levels that change at a first rate when the backlight ramping control is enabled, and wherein the backlight unit outputs backlight levels that change at a second rate that is greater than the first rate when the backlight ramping control is disabled.

13. The method defined in claim 10, wherein the system further includes a display timing controller, the method further comprising:

with the display timing controller, asserting a control signal that is fed to the backlight unit to disable a ramp control circuit in the backlight unit when transitioning from the fixed pixel brightness mode to the dynamic pixel brightness mode.

14. The method defined in claim 10, wherein the system further includes a display timing controller, the method further comprising:

providing a control signal to the backlight unit with the display timing controller, wherein the control signal has duty cycles that change at a first rate when the backlight unit is operating in the dynamic pixel brightness mode, and wherein the control signal has duty cycles that change at a second rate that is less than the first rate when the backlight unit is operating in the fixed pixel brightness mode.

15. The method defined in claim 10, wherein the system further includes a display timing controller, a graphics controller, and a processor, the method further comprises:

sending incremental backlight level adjustments to the display timing controller with the processor circuit via the graphics controller when the backlight unit is in the dynamic pixel brightness mode.

16. A system, comprising:

a graphics controller; and a display that is operable in a static display mode and a video display mode and that is coupled to the graphics controller via a display port, wherein the display comprises:

a display timing controller; and a backlight unit that receives an enable signal from the display timing controller, wherein the display timing controller is configured to assert the enable signal while the display is transitioning from the static display mode to the video display mode.

17. The system defined in claim 16, wherein the backlight unit includes a slope control circuit that is enabled when the enable signal has a first value and that is disabled when the enable signal has a second value that is different than the first value, and wherein the slope control circuit is used to provide backlight ramp control only during the static display mode.

18. The system defined in claim 16, wherein the static display mode comprises a non-movie mode and wherein the the video display mode comprises a movie mode.

19. The system defined in claim 16, wherein the display timing controller includes a dynamic pixel backlight control circuit that is operable to produce a control signal to the backlight unit, wherein the control signal exhibits duty cycles that change at a first rate when the display is operating in the static display mode, and wherein the control signal exhibits duty cycles that change at a second rate that is greater than the first rate when the display is operating in the video display mode.

20. The system defined in claim 16, further comprising:

storage and processing circuit that is coupled to the backlight unit via an inter-integrated circuit bus.

* * * * *

UNITED STATES PATENT AND TRADEMARK OFFICE

CERTIFICATE OF CORRECTION

PATENT NO. : 8,976,092 B2
APPLICATION NO. : 13/756259
DATED : March 10, 2015
INVENTOR(S) : Asif Hussain et al.

It is certified that error appears in the above-identified patent and that said Letters Patent is hereby corrected as shown below:

In the Claims

In claim 18, column 14, lines 37-38, delete "wherein the the video display mode" and insert -- wherein the video display mode --

Signed and Sealed this
Twenty-first Day of July, 2015

Michelle K. Lee

Michelle K. Lee
*Director of the United States Patent and Trademark Office*